US006586879B1

(12) United States Patent
Shino et al.

(10) Patent No.: US 6,586,879 B1
(45) Date of Patent: Jul. 1, 2003

(54) AC PLASMA DISPLAY DEVICE

(75) Inventors: Taichi Shino, Ikoma-gun (JP); Takio Okamoto, Kusatsu (JP); Kazunori Hirao, Yao (JP)

(73) Assignee: Matsushita Electric Industrial Co., Ltd. (JP)

( * ) Notice: Subject to any disclaimer, the term of this patent is extended or adjusted under 35 U.S.C. 154(b) by 189 days.

(21) Appl. No.: 09/690,822

(22) Filed: Oct. 18, 2000

(30) Foreign Application Priority Data

Oct. 22, 1999 (JP) ..... 11-300972

(51) Int. Cl.[7] ..... H01J 17/49
(52) U.S. Cl. ..... 313/582; 313/585; 313/586
(58) Field of Search ..... 313/582, 590, 313/610, 491, 584, 609, 583, 585, 586, 587, 484–486, 495, 496

(56) References Cited

U.S. PATENT DOCUMENTS

| | | | | |
|---|---|---|---|---|
| 6,008,582 A | * | 12/1999 | Asano et al. | 313/582 |
| 6,195,070 B1 | * | 2/2001 | Shinoda et al. | 313/485 |
| 6,249,264 B1 | * | 6/2001 | Sano et al. | 313/582 |
| 6,380,678 B1 | * | 4/2002 | Kim | 313/582 |
| 2002/0047518 A1 | * | 4/2002 | Lin et al. | 313/582 |
| 2002/0047519 A1 | * | 4/2002 | Kunii et al. | 313/584 |

FOREIGN PATENT DOCUMENTS

| | | |
|---|---|---|
| JP | 10321148 A | 12/1998 |
| JP | 11260264 A | 9/1999 |

* cited by examiner

*Primary Examiner*—Ashok Patel
*Assistant Examiner*—German Colón
(74) *Attorney, Agent, or Firm*—Parkhurst & Wendel, L.L.P.

(57) ABSTRACT

Disclosed is an AC plasma display device for preventing an error discharge, improving a luminous intensity, and applicable to high definition display. The device includes a front substrate, which has display electrodes in parallel to each other and a non-display line. The line and the display electrode are arranged alternately each other on the front substrate. Further, the device comprises a rear substrate, which has a plurality of data electrodes extending in a direction perpendicular to the display electrodes. The rear substrate forms a discharge space between itself and the front substrate, defines a gap of the discharge space, and has a partition in a belt shape placed between adjoining data electrodes. Furthermore, the rear substrate has a barrier between the partitions at a position facing to the non-display portion so as to have width corresponding to the non-display portion, form a gap between itself and the front substrate, and prevent an error discharge between the display electrodes.

3 Claims, 12 Drawing Sheets

AC PLASMA DISPLAY DEVICE

FIELD OF THE INVENTION

The present invention relates to an AC plasma display device used for a television receiver, an advertising display panel, and other image displays.

BACKGROUND OF THE INVENTION

FIG. 9 illustrates a main structure of a conventional AC plasma display device. In the figure, a scan electrode 4 and sustain electrode 5 form a pair, which refers simply to display electrode, in a stripe shape. A plurality of the pairs is arranged in parallel on front substrate 1 and covered by dielectric layer 2 and protect film 3. Light shielding layer 6 is located between adjacent display electrodes (pairs of scan electrode 4 and sustain electrode 5). Scan electrode 4 and sustain electrode 5 are composed of transparent electrodes 4*a* and 5*a* and bus lines 4*b* and 5*b* respectively. The bus lines are made of silver and the like, and are stick to and electrically connected to the transparent electrodes respectively.

A plurality of data electrodes 9 covered by insulating layer 8 is arranged on rear substrate 7. A plurality of partitions 10 is on insulating layer 8. Each one of partitions 10 is located in parallel with and between adjacent data electrodes 9. Phosphor 11 is coated on side partitions 10*a* and a surface of insulating layer 8 which are between partitions 10 adjacent to data electrode 9.

Rear substrate 7 and front substrate 1 are placed facing to each other so that data electrodes 9 and the display electrodes extend in an perpendicular direction to each other, and define discharge spaces 12, where the display electrode include scan electrode 4 and sustain electrode 5. Discharge spaces 12 enclose helium, neon, argon, and xenon or a mixture of some of them as an ionizable gas.

In short, in a panel designed like this, the display electrode composed of scan electrode 4 and sustain electrode 5 and data electrode 9 are arranged to form an intersection region between themselves, and the intersection region corresponds to one discharge cell.

Next, an operation of the display panel mentioned above is described.

First, FIG. 10 shows that arrays of electrodes of this display panel form a matrix structure of discharge cells with M lines and N rows, and the M lines have scan electrodes SCN1 through SCNM and sustain electrodes SUS1 through SUSM in the line direction, the N rows have data electrodes D1 through DN in the row direction. FIG. 11 shows a timing chart illustrating a driving method of this AC plasma display panel FIGS. 10 and 11 illustrate the following. In a write period, after all sustain electrodes SUS1 through SUSM are held at 0 volts, a positive write pulse voltage +Vw volts is applied to specified data electrodes of D1 through DN corresponding to desired discharge cells for display in the first line, and a negative scan pulse −Vs volts is applied to the first line scan electrode SCN1. This causes write discharges at intersection regions between the specified data electrodes and the first line scan electrode SCN1.

Next, a positive write pulse voltage +Vw volts is applied to specified data electrodes of D1 through DN corresponding to desired discharge cells for display in the second line, and a negative scan pulse −Vs volts is applied to the second line scan electrode SCN2. This causes write discharges at intersection regions between the specified data electrodes and the second line scan electrode SCN2.

Similar operations described above are successively performed. Finally, a positive write pulse voltage +Vs volts is applied to specified data electrodes of D1 through DN corresponding to desired discharge cells for display in the Mth line, and a negative scan pulse −Vs is applied to the Mth line scan electrode SCNM. This causes write discharges at intersection regions between the specified data electrodes and the Mth line scan electrode SCNM.

In a sustain period, all scan electrodes SCN1 through SCNM are held at 0 volts, and a negative sustain pulse voltage −Vm volts is applied to all sustain electrodes SUS1 through SUSM. This causes sustain discharges between scan electrodes SCN1 through SCNM and sustain electrodes SUS1 through SUSM at the intersections where the write discharges are caused in the previous write period.

Next, negative sustain pulse voltage −Vm volts is applied to all scan electrodes SCN1 through SCNM and all sustain electrodes SUS1 through SUSM alternately. This causes the sustain discharges at desired discharge cells for display to be maintained continuously. These light emissions from the sustain discharges produce a panel display.

In a next erase period, all scan electrodes SCN1 through SCNM are held once at 0 volts. Then an erase pulse voltage −Ve volts is applied to all sustain electrodes SUS1 through SUSM. This causes erase discharges to stop the sustain discharges. The above-described operation displays a frame of AC plasma display panel.

Here, explained is a stability and a luminous intensity of the sustain discharge in the above-description.

FIG. 12 is a sectional view taken on line XII—XII of FIG. 9. FIG. 13 is a sectional view taken on line XIII—XIII of FIG. 9. FIG. 12 and 13 show a dimensional relationship between scan electrode 4 and sustain electrode 5 and a state of a sustain discharge in case of scan electrode SCNi and sustain electrode SUSi in an i line; and scan electrode SCNi+1 and sustain electrode SUSi+1 in an i+1 line.

A sustain discharge described by a solid line double-headed arrow in FIG. 12 is a discharge between scan electrode SCNi and sustain electrode SUSi in the i the line; or between scan electrode SCNi+1 and sustain electrode SUSi+1 in the i+1 the line, namely scan electrode 4 and sustain electrode 5 in the same line. Therefore, electrode gaps G may be narrow. A discharge between sustain electrode SUSi+1 and scan electrode SUSi described by a dotted line double-headed arrow in FIG. 12 is false discharge Y which is undesired sustain discharge. Therefore, the distance D between electrodes of sustain electrode SUSi+1 and scan electrode SCNi is kept wide enough so as for error discharge not to occur.

Scan electrode 4 and sustain electrode 5 comprise transparent electrodes 4*a*, 5*a* and bus lines 4*b*, 5*b* made of silver and the like respectively. Therefore, bus lines 4*b*, 5*b* are opaque. As a result, luminous intensity lowers at the position of bus lines 4*b*, 5*b* as FIG. 14 shows a luminous intensity distribution characteristics. To prevent this lowering of the intensity, reducing electric resistance of bus lines 4*b*, 5*b* is kept as low as possible and the bus lines' width is made to be narrow. This prevents a lowering of the intensity resulting from the bus lines' width.

However, in the conventional panel design described above, a distance D between electrodes of sustain electrode SUSi+1 and scan electrode SCNi decreases inevitability as shown in FIG. 15, if the line number M increases to realize high definition. Accordingly, when the line number M increases and exceeds a specific value, a error discharge described by a dotted line double-headed arrow occurs between sustain electrode SUSi and scan electrode SCNi+1. Then the display panel device may not form the display normally.

Furthermore, realizing the high definition makes a ratio of area of bus lines 4*b*, 5*b* to an area of transparent electrodes 4*a*, 5*a* be increased for bus lines 4*b*, 5*b* to get adhesion to transparent electrodes 4*a*, 5*a*. As a result, the luminous intensity distribution characteristics lowers at the position of bus lines 4*b*, 5*b*

SUMMARY OF THE INVENTION

The present invention provides a high display quality and high definition display panel device which does not have a error discharge and improves luminous intensity, even if a high definition display requires a structure of display electrodes to decrease a distance between the electrodes.

To realize the improvement mentioned above, an AC plasma display device of the present invention comprises:

(a) a transparent front substrate which has a plurality of display electrode rows having a non-display portion between the display electrode rows:

(b) a rear substrate which has an array of data electrodes in an orthogonal direction to the display electrodes and is arranged facing to the front substrate so as to define a discharge space between the rear substrate itself and the front substrate;

(c) a belt shaped partition which is placed so as to divide the discharge space between the rear substrate itself and the front substrate into divided discharge spaces corresponding to the data electrodes on the rear substrate and to define gaps of the divided discharge spaces; and (d) a barrier which is placed between the partitions on the rear substrate, has a width corresponding to the non-display portion at a position facing the non-display portion on the front substrate, forms a gap between itself and the front substrate, and is able to prevent a error discharge between the display electrodes.

This structure allow a distance between a pair of adjacent display electrodes having a non-display portion between the electrodes to be reduced to prevent a error discharge, even if a high definition display requires a structure of display electrodes to decrease a distance between the electrodes.

DESCRIPTION OF THE PREFERRED EMBODIMENTS

An AC plasma display device in accordance with an embodiment of the present invention is described with reference to FIGS. 1 through 8 as follows.

Figure 1:
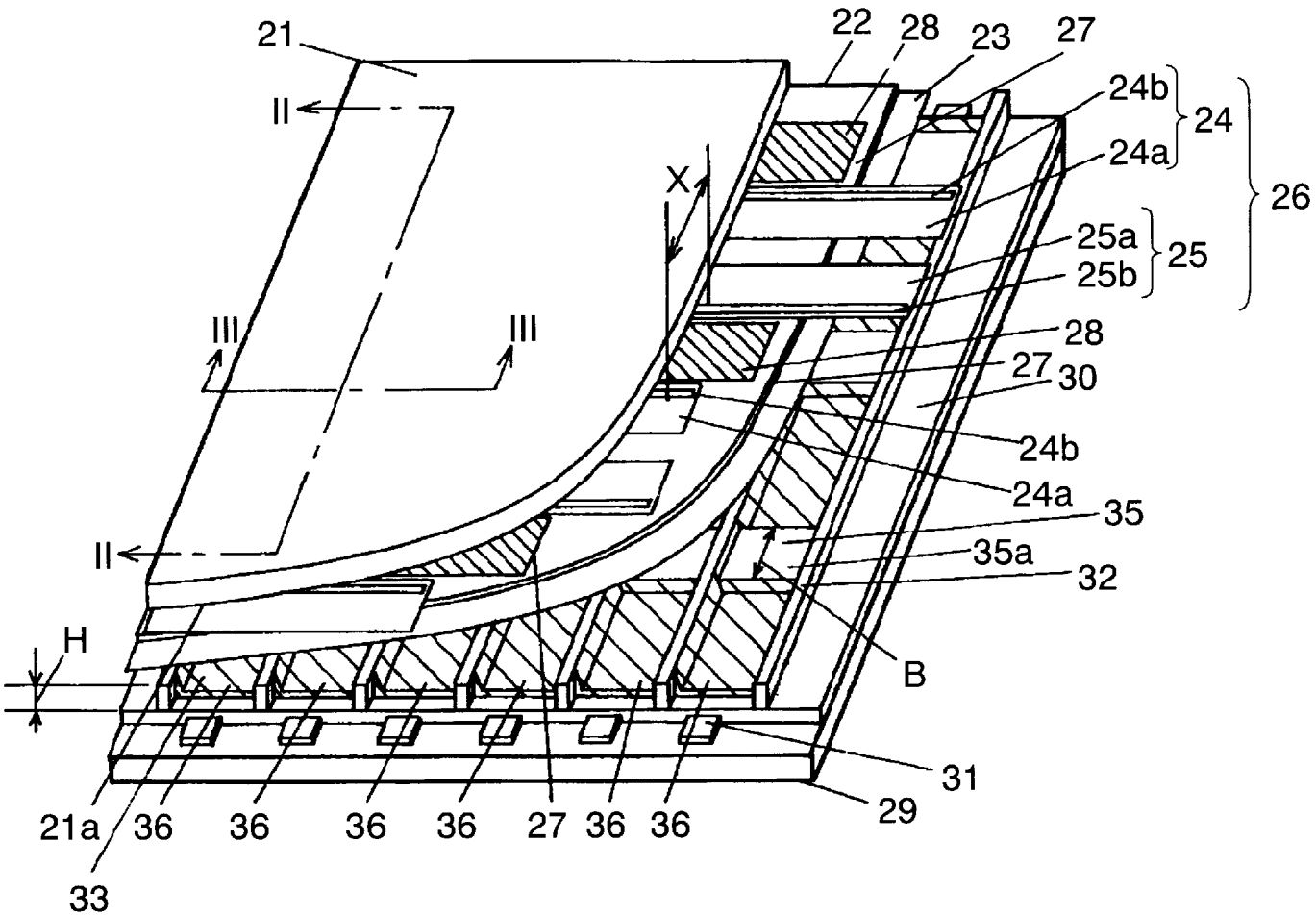
FIG. 1 shows a main perspective view of a panel structure in cross-section of an AC plasma display device in accordance with an embodiment of the present invention.
Figure 2:
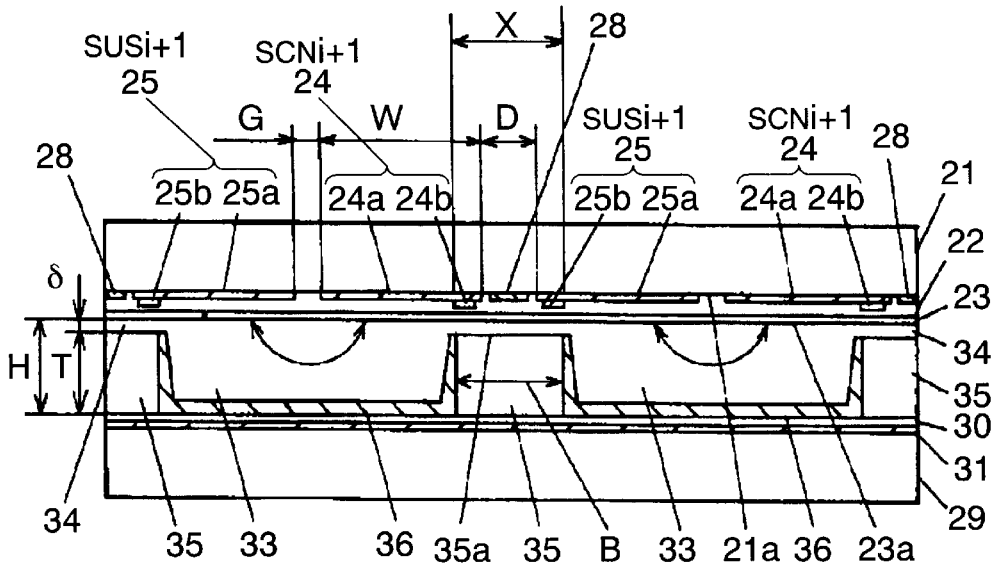
FIG. 2 is a sectional view taken on line II—II of FIG. 1.
Figure 3:
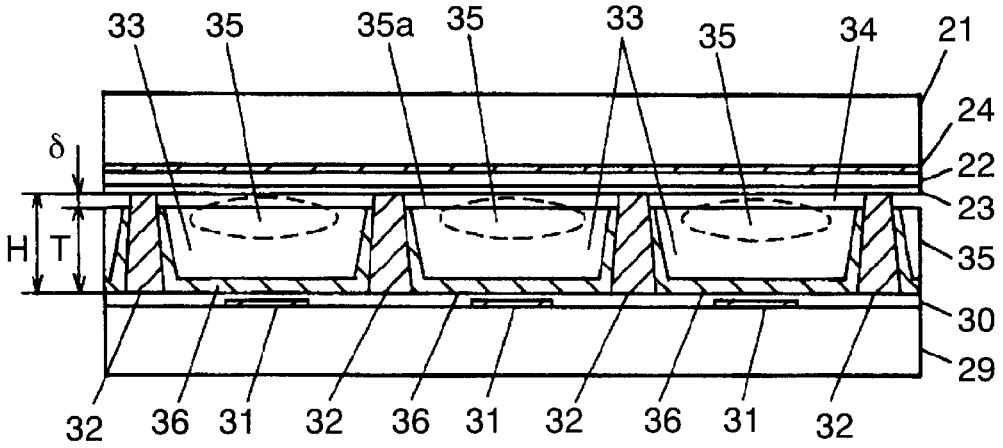
FIG. 3 is a sectional view taken on line III—III of FIG. 1.

FIG. 1 is a main perspective view of a panel of an AC plasma display device in accordance with an embodiment of the present invention, and FIG. 2 and FIG. 3 are sectional views taken on lines II—II and III—III of FIG. 1 respectively.

As shown in FIGS. 1 through 3, scan electrode 24 and sustain electrode 25 form a pair referring simply to display electrode 26 in a stripe shape. A plurality of the pairs is arranged in parallel on front substrate 21 and covered by dielectric layer 22 and protect film 23 so as to form non-display portion 27 between the pairs. Non-display portion 27 is between adjacent display electrodes 26 (pairs of scan electrode 24 and sustain electrode 25) where light shielding layer 28 is located. Scan electrode 24 and sustain electrode 25 comprise transparent electrodes 24*a* and 25*a* and bus lines 24*b* and 25*b*respectively, so as for the bus lines 24*b*, 25*b* made of silver and the like to be stick to and electrically connected to the transparent electrodes 24*a*, 25*a*, at an end of non-display portion side on the transparent electrodes 24*a*, 25*a* respectively. Generally, as transparent electrodes 24*a*, 25*a* are of high electric resistance, forming bus lines 24*b*, 25*b* with low resistance material such as silver provide scan electrode 24 and sustain electrode 25 with low resistance.

Likewise, an array of data electrodes is placed on rear panel 29 comprising transparent glass substrate and the like. The array is covered by insulating layer 30 and in an orthogonal to the display electrodes 26. A plurality of partitions 32 made of glass and the like is placed between data electrodes 31 on insulating layer 30 in parallel with data electrode 31

Rear substrate 29 and front substrate 21 are placed facing to each other, so as for data electrodes 31 and display electrodes 26 composed of scan electrodes 24 and sustain electrodes 25 to extend in an orthogonal direction to each other, and to define discharge space 33 between substrates 29 and 21. Discharge spaces 33 enclose helium, neon, argon, and xenon or a mixture of some of them as an ionizable gas.

A discharge cell in the above-described panel structure is formed at a intersection region of data electrode 24 and a display electrode composed of a pair of scan electrode 24 and sustain electrode 25. Belt shaped partitions 32 placed between data electrodes 31 on rear substrate 29 divide discharge space 33 into divided discharge spaces corresponding to data electrodes and define gap dimension H in thickness direction of the panel.

Furthermore, in the present invention, barrier 35, which is placed at a position facing to non-display portion 27 of front substrate 21 between partitions 32 on rear panel 29, has a width corresponding to non-display portion 27, forms gap 34 between itself and front substrate 27, and prevent error discharges occurring between display electrodes.

Phosphors 36 emitting red, blue, and green lights are arranged in a stripe shape in sequence separated by partition 32 respectively, on the sides of partition 32, the sides of barrier 35, and the surface of insulating layer 28 between partitions 32.

Here, gap 34 formed by barrier 35 between barrier 35 and front substrate 21 has:

i) a function making ionizable gas connect adjacent discharge spaces 33 for display electrodes 26, ii) a function preventing error discharges between adjacent display electrodes by defining a appropriate distance of gap 34.

In other words, gap 34 is formed between front substrate 21 and gap surface 35*a* facing to front substrate 21, and barrier surface 35*a* is placed in parallel with front substrate surface 21*a*. Furthermore, a relation $\delta \leqq D/3$ is satisfied, given that height H of partition 32, height T of barrier 35, difference δ between height H and T, distance D between adjacent pairs of scan electrode 24 and sustain electrode 25, and the pairs separated by non-display portion 27, on front substrate. A distance X between bus line 24*b* of scan electrode 24 and bus line 25*b* of sustain electrode 25, where scan electrode 24 and sustain electrode 25 are adjoining each other and are sandwiching the non-display portion 27, is defined so as to be narrower than width B of barrier 35 in the direction of the length of partition 32. Here, the distance X includes each width of the bus lines 24*b* and 25*b*.

Figure 10:
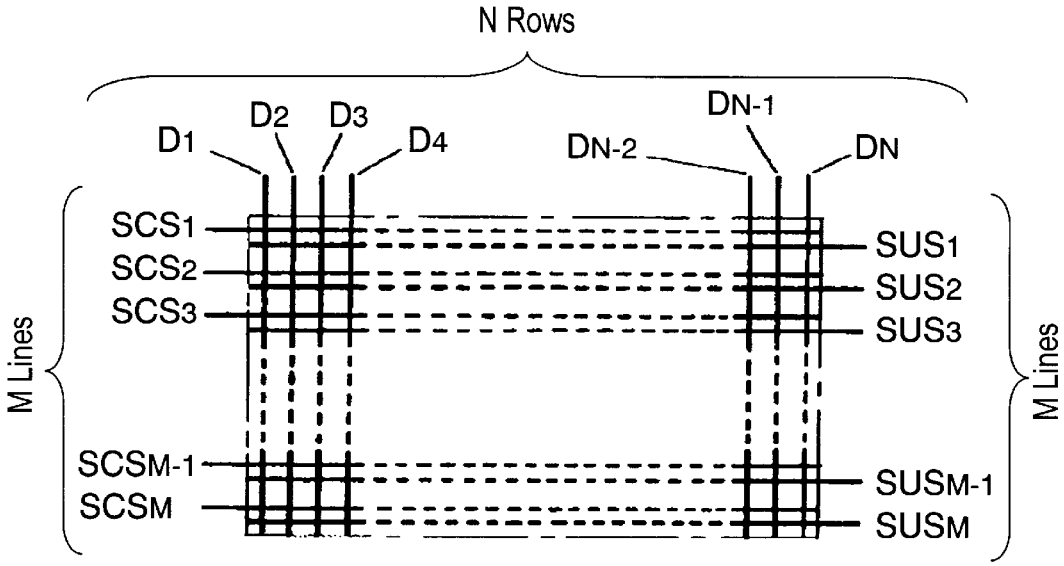
FIG. 10 PRIOR ART
FIG. 10 is illustration of electrode arrays of the panel.
Figure 11:
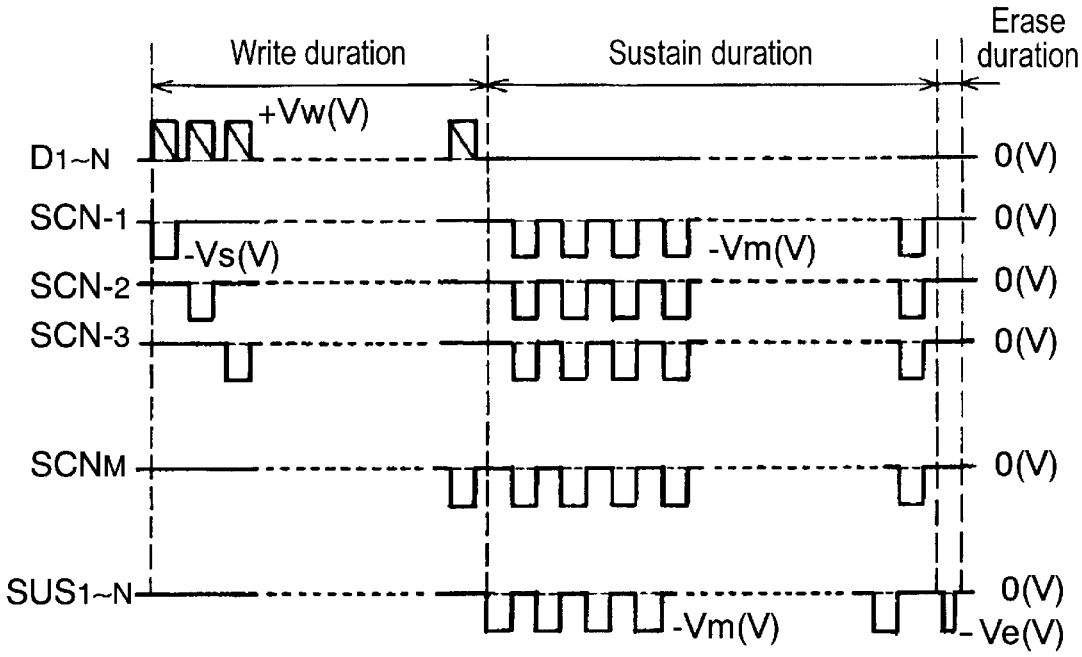
FIG. 11 PRIOR ART
FIG. 11 shows a timing chart illustrating an operation of the panel.
Figure 12:
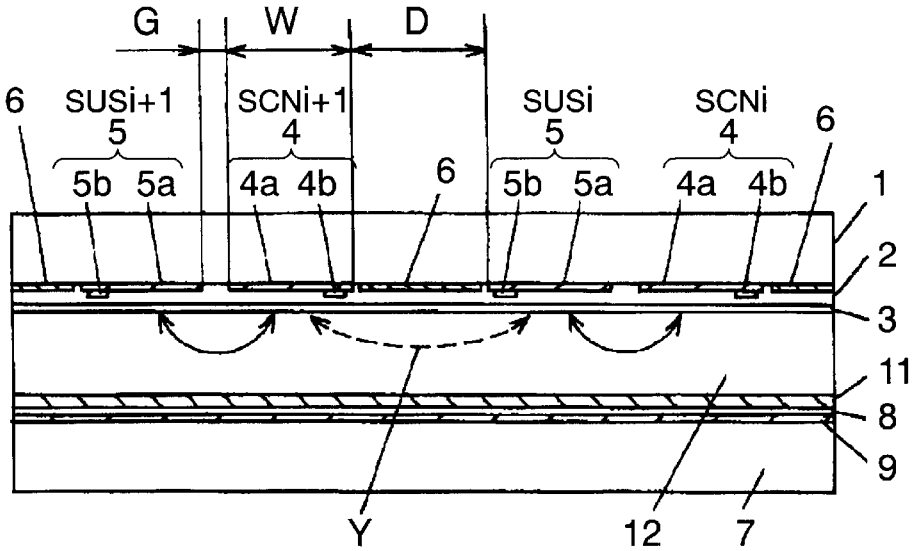
FIG. 12 PRIOR ART
FIG. 12 is a sectional view taken on line XII—XII of FIG. 9.
Figure 13:
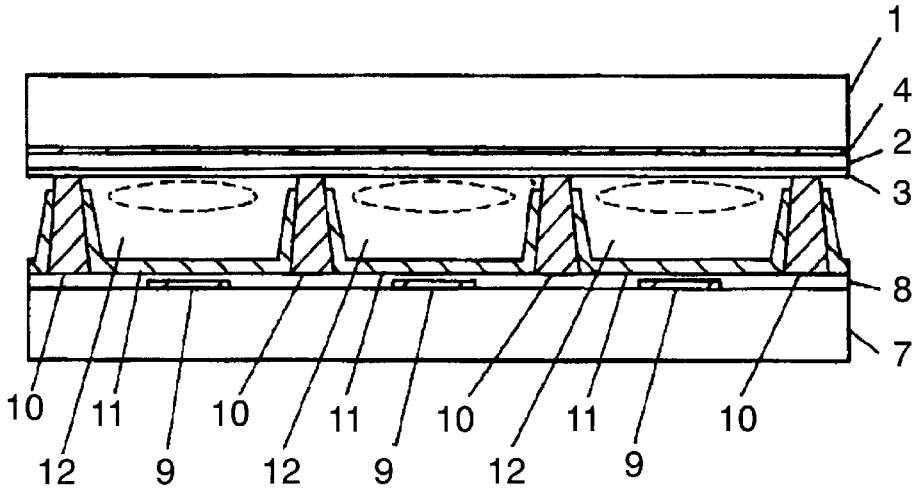
FIG. 13 PRIOR ART
FIG. 13 is a sectional view taken on line XIII—XIII of FIG. 9.

Besides, an arrangement of electrodes and timing chart of this display panel are the same as FIGS. 10 and 11 for illustration of conventional display panel.

Above-described panel in accordance with the embodiment of the present invention has barrier 35 preventing error discharge between adjacent display electrodes 26 on rear substrate at a portion facing to non-display portion 27 of front substrate 21. Therefore, even if a high definition display requires display electrode structure having downsized discharge cell, as distinct from a prior art, this structure allow a distance between a pair of adjacent display electrodes 26 having non-display portion 27 between them to be downsized so as to prevent an error discharge As a result, the embodiment of the present invention has advantages as follows.

i) Broadening width W of display electrodes 26 and emitting area of each cell allows luminous intensity to rise.

ii) Preventing error discharge between a pair of adjacent display electrodes 26 having non-display portion 27 between them allows a display to be high contrast.

iii) When display electrode is composed of transparent electrodes 24*a*, 25*a* and bus lines 24*b*, 25*b*, as comparing to a prior art, an area ratio of bus lines 24*b*, 25*b* to transparent electrodes 24*a*, 25*a* is reduced. This allows luminous intensity to rise.

iv) Gap 34 makes ionizable gas connect discharge spaces 33 for adjacent display electrodes 26. Therefore, just defining opening size of gap 34 can prevent error discharge between adjacent display electrodes 26. Further, gap 34 is formed between front substrate 21 and barrier surface 35*a* facing to front substrate 21.

In other words, partition 32 and gap 34 are placed on rear substrate 29. Accordingly, partition 32 and barrier 35 are formed with, for example, sandblast method from one side simultaneously. Therefore, partition 32 and barrier 35 are manufactured easily. Especially, as partition surface 35*a* facing to front substrate 21 is formed in parallel with front substrate surface 21*a*, the manufacturing is easy in the same way as mentioned above.

Further, a distance X between bus lines 24*b* and 25*b* of adjoining display electrodes 26 sandwiching the non-display portion 27 is narrower than width B in the direction of the length of partition 32. Therefore, opaque bus lines 24*b*, 25*b* do not cut off light emission from a dishrag of display electrode 26. As a result, this allows display luminous intensity of a discharge cell to be improved comparing to conventional display panel.

Furthermore, as phosphor 36 is located on sides of barrier 35, phosphor 36 can emits light from the place near to the discharge of display electrode 26. As a result, this allows display brightness of visible light emitted from a discharge cell to be more improved.

Next, confirmed concrete examples of effects of the present invention are described.

EXAMPLE 1

Figure 4:
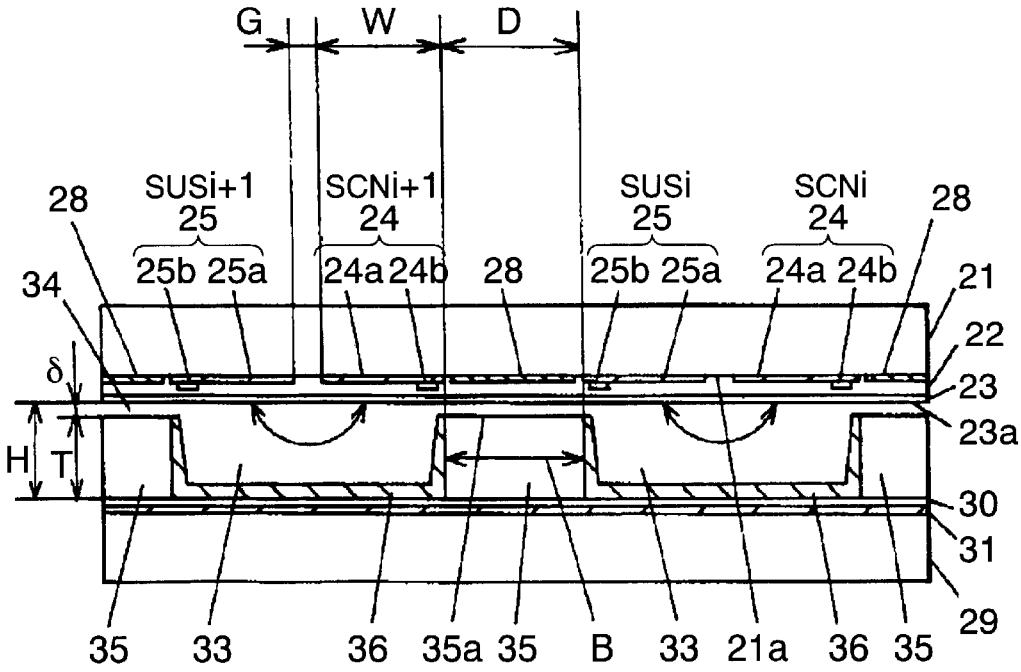
FIG. 4 is a cross-sectional view of a main structure of a panel of an AC plasma display device in accordance with another embodiment of the present invention.

A display panel in accordance with the example 1 of the present invention is a 42-inch diagonal panel with 480 lines and 852 rows as shown in FIGS. 1, 3, and 4. Here, in the example 1, the following conditions are used.

Electrode gaps G=80 μm, electrode width W of scan electrode 4 and sustain electrode 5 is 370 μm, distance D between electrodes is 260 μm, width B of barrier 35 is 260 μm, and height H of partition 32 is 120 μm.

Figure 5:
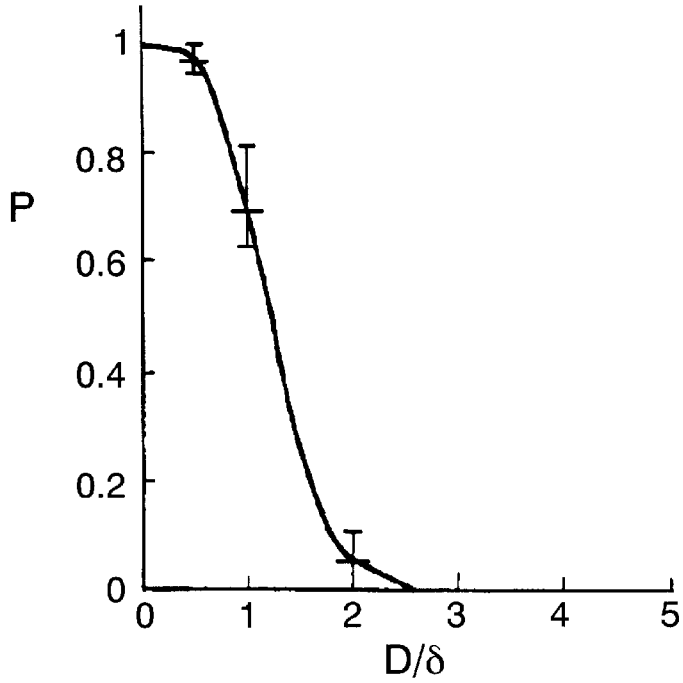
FIG. 5 is a characteristics of a error discharge probability with respect to height of a barrier of a panel of an AC plasma display device in accordance with the present invention.

A relation between a probability of occurrence of an error discharge and a ratio of distance D between electrodes to gap is investigated using this panel with height T of barrier 35 changed The result is shown in FIG. 5.

The figure shows that the probability of error discharge for the panel of the present invention is lower with gap δ decreased namely D/δ increased, and safely zero when a relation $D/\delta \geqq 3$ is satisfied. In other words, setting gap δ to lower than ⅓ of distance D between electrodes can prevent the error discharge. When D/δ is higher than 3, the panel is able to have a safety margin for the error discharge to occur.

Consequently, forming barrier 35 allows the probability of occurrence the error discharge to be reduced.

EXAMPLE 2

Next, in the example 2, the following conditions are used.

A 42 inch diagonal panel with specified number of lines and 852 rows with height T of barrier 35 is 80 μm namely $D/\delta \geqq 3$. An area of distance D between electrodes is investigated about number M of lines, at which an error discharge occurs, with this panel.

Figure 6:
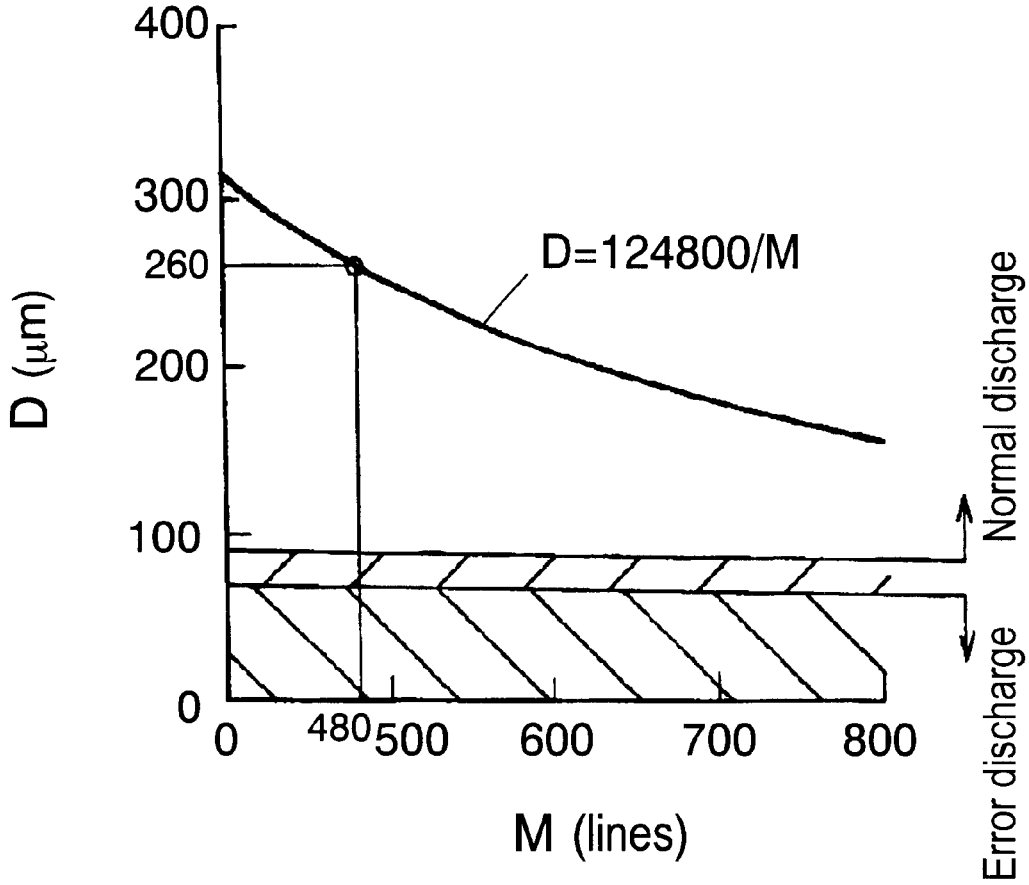
FIG. 6 is a characteristics of a range a error discharge occurs with respect to a distance between electrodes of the panel.

The result is shown in FIG. 6. Besides, other specifications are the same as the example 1.

To be compared with the result, an area of distance D between electrodes is investigated about number of lines, at which a error discharge occurs, with a conventional structure panel corresponding to the panel of the example 2, from which only barrier 25 is removed. The result is shown in FIG. 15.

Figure 15:
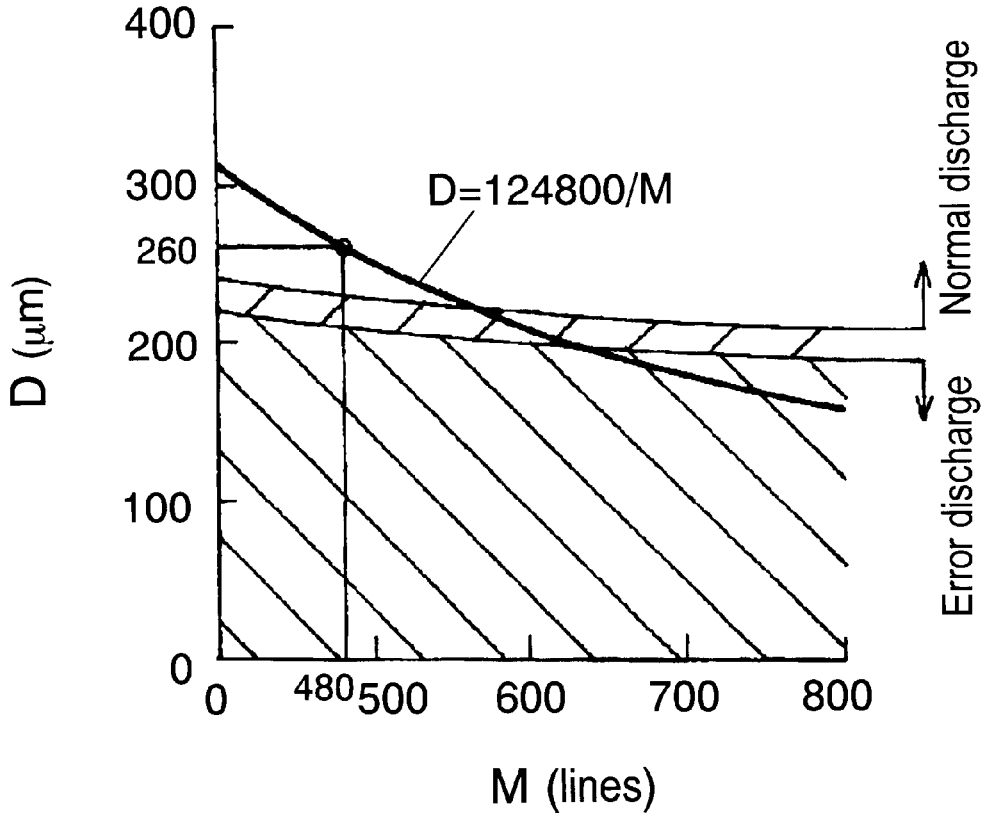
FIG. 15 PRIOR ART
FIG. 15 is a characteristics of a range a error discharge occurs with respect to a distance between electrodes of the panel.

As shown in FIGS. 6 and 15, distance D between electrodes is inversely proportional to number M of lines ($D=480\times260/M=124800/M$).

In short, when number M of lines increases, distance D between electrodes decreases. The figures shows that the error discharge at distance D of electrodes occurs if number M of lines exceeds about 600 lines in the conventional panel, while the error discharge does not occurs even if number M of lines exceeds 800 lines in the panel of the example 2, and distance D between electrodes has enough margin.

Consequently, forming barrier 35 allows the probability of the error discharge to be reduced, even if a high definition display requires display electrodes to decrease a distance between the electrodes.

EXAMPLE 3

Next, the example, the following conditions are used.

Figure 7A:
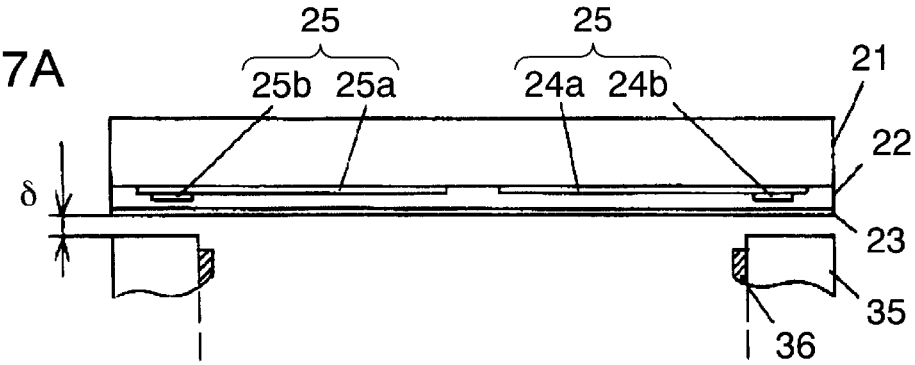
FIGS. 7(*a*), (*b*), and (*c*) are illustrations of a discharge intensity distribution and a luminous intensity distribution in a discharge cell of the panel.
Figure 7B:
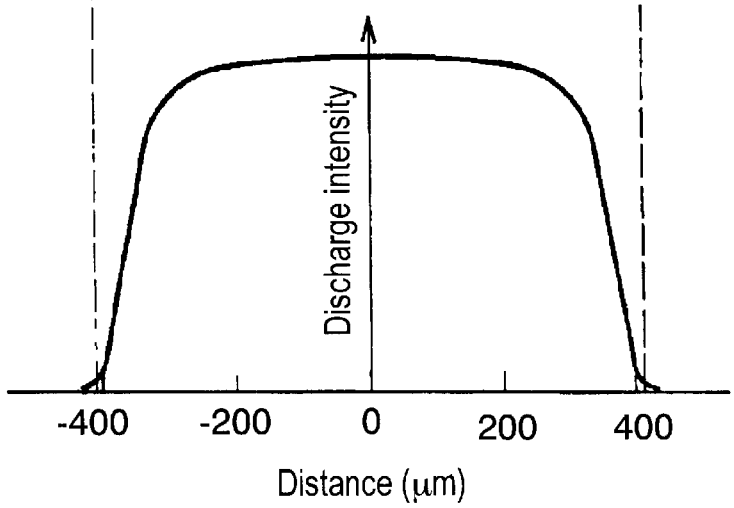
Figure 7C:
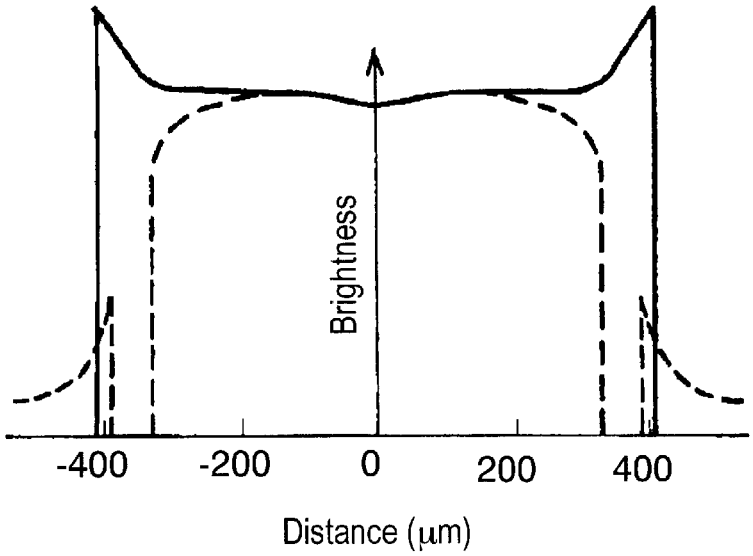

Distance D between electrodes is 90 $\mu$m, electrode width W of scan electrode 4 and sustain electrode 5 is 455 $\mu$m, and height T of barrier 35 is 80 $\mu$m. Barriers 35 satisfy $D/\delta \geqq 3$ in FIG. 2. A discharge intensity distribution and a luminous intensity distribution between scan electrode 4 and sustain electrode 5 is investigated using the panel. The result is shown in FIGS. 7(*b*) and (*c*). Besides, other specifications are the same as the example 1.

To be compared with the result, a discharge intensity distribution and a luminous intensity distribution is investigated with the above-mentioned specifications of a conventional panel. The result is shown in FIGS. 14(*b*) and (*c*).

Figure 14A:
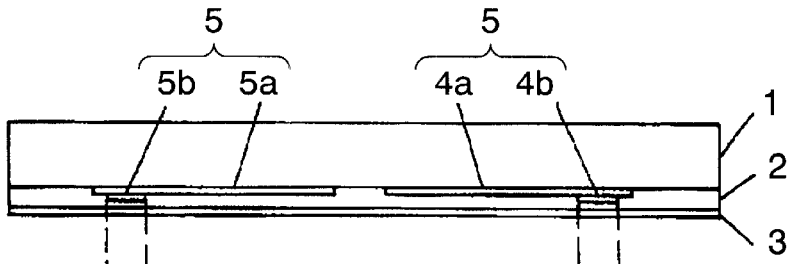
FIG. 14A PRIOR ART
FIG. 14 is illustration of a discharge intensity distribution and a luminous intensity distribution in a discharge cell of the panel.
Figure 14B:
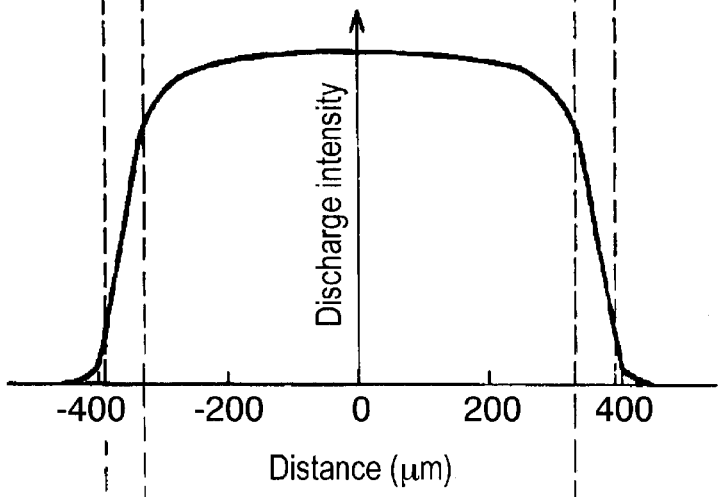
FIG. 14B PRIOR ART
Figure 14C:
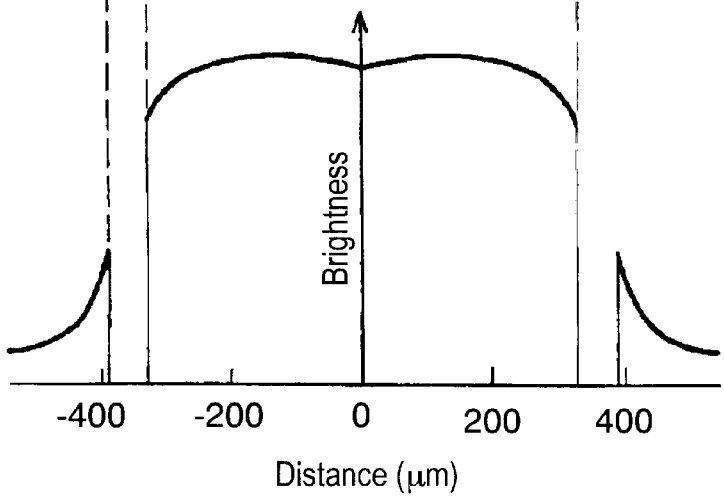
FIG. 14C PRIOR ART

As shown in FIG. 7(*b*) and FIG. 14(*b*), a discharge intensity distribution of the panel of the present invention is almost the same as the conventional panel. But, the figures shows that the luminous intensity near scan electrode 24 and bus lines 24*b* of sustain electrode 24 and 25*b* of sustain electrode 25 is down to zero in the conventional panel. On the other hand, the intensity at the same portion in the panel of the present invention is higher than intensity at the center of the discharge cell. A measured value of the luminous intensity of the panel of the present invention is about 1.3 times of the luminous intensity of the conventional panel. Here, the reason why the above-mentioned intensity is down to zero in the conventional panel is that bus lines 24*b*, 25*b* cut off the light emission. The reason why the above-mentioned intensity is high in the panel of the present invention, is that bus lines 24*b*, 25*b* does not cut off the light emission, and phosphor 36 is located on sides of barrier 35.

The above-mentioned embodiment of the present invention describes a panel structure for a color display using red, blue, and green phosphors. However, the present invention is adaptable to not only color panel structures, but also panel structures using only one color phosphor, as well as panel structures emitting discharge color light directly without the phosphor.

Besides, a method for driving a panel is not confined to the driving method mentioned above.

In the embodiments mentioned above, gap 34 is formed by front substrate 21, barrier surface 35 facing to front substrate surface 21*a*. But, the gap may be replaced by a round hole, a square hole, or a slot formed on the side of barrier 35.

The method for forming barrier 35 is not only a sandblast method but also a printing method.

Figure 8:
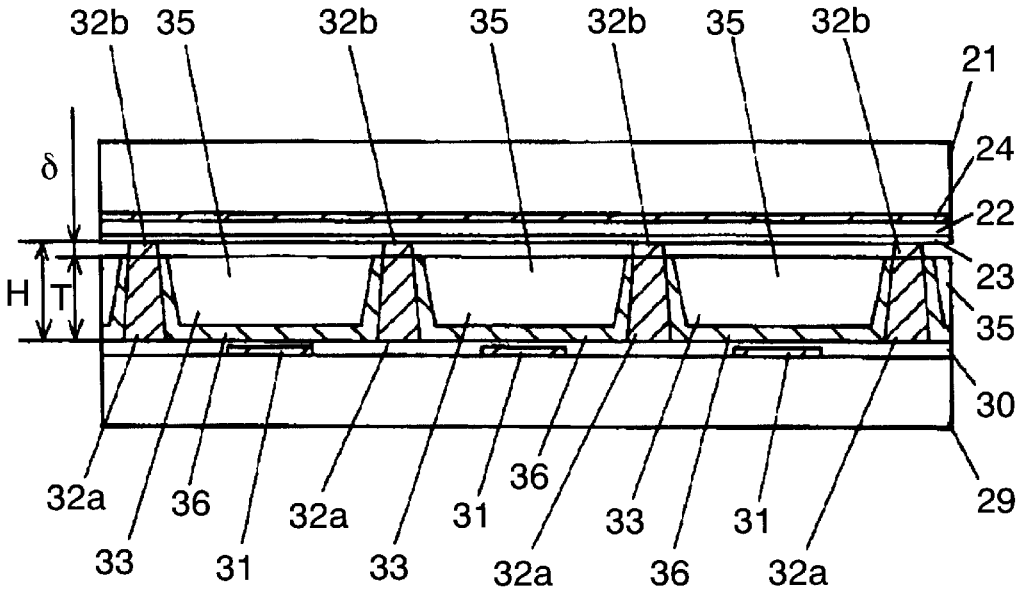
FIG. 8 is a cross-sectional view of a main structure of a panel of an AC plasma display device in accordance with yet another embodiment of the present invention.
Figure 9:
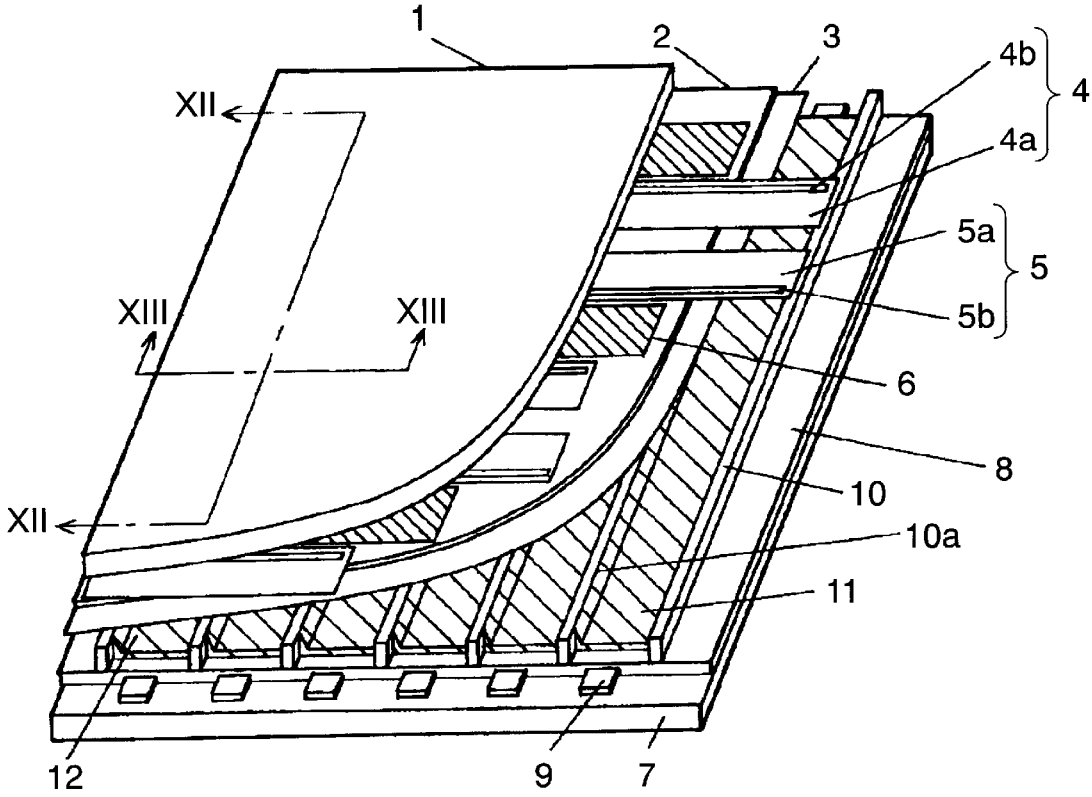
FIG. 9 PRIOR ART
FIG. 9 shows a main perspective view of a panel structure in cross-section of a conventional AC plasma display device.

In the embodiments mentioned above, partition 32 with height H is located only on a side of front substrate 21. But, a method for forming gap is not confined to this method. As shown in FIG. 8, partition 32*a* having the same height as height T of partition 35 and partition 32*b* with height H–T may be disposed on rear substrate 29 and front substrate 21 respectively.

As mentioned above, the AC plasma display device in accordance with the present invention does not have an error discharge between display electrodes and improves lowering luminous intensity, even if a high definition display requires a structure of display electrodes to decrease a distance between the electrodes. Therefore, the present invention provides a high display quality and high definition display panel device

What is claimed:

1. An AC plasma display device having structure for preventing error-discharges, comprising:

a transparent front substrate having an array of display electrodes comprising a non-display portion located between the display electrodes, a rear substrate comprising an array of data electrodes in a direction perpendicular to the display electrodes and located facing the front substrate and defining a discharge space between said rear substrate and said front substrate, a first partition located to form the discharge space between the data electrodes on said rear substrate and to define a gap of the discharge space, a barrier located between said partitions on said rear substrate and at a position facing the non-display portion on said front substrate, an upper surface of said barrier being in parallel with a face of said front substrate, a height of said barrier being lower than a height of said partition; and a second partition located on said front substrate at a position corresponding to said first partition, contacting said first partition at their tops, forming the discharge space and defining a gap of the discharge space with said first partition, wherein said barrier has a width corresponding to the non-display portion, and a non-zero difference between the height of said partition and the height of said barrier on said rear substrate is not greater than ⅓ of a distance between display electrodes which adjoin each other and sandwich the non-display portion.

2. The AC plasma display device as defined in claim 1, the display electrode further comprising:

a transparent electrode; and a bus line located at an end of the transparent electrode close to the non-display portion, wherein a distance between the bus lines adjoining each other sandwiching the non-display portion is less than a width of the barrier, where the distance includes each width of the bus lines of the display electrodes.

3. The AC plasma display device as defined in claim 1, wherein phosphor is located on a side of said barrier.

* * * * *